US012604975B2

(12) United States Patent
Shen et al.

(10) Patent No.: US 12,604,975 B2
(45) Date of Patent: Apr. 21, 2026

(54) PORTABLE TABLE

(71) Applicant: Linhai Sunrise Leisure Products Co., Ltd., Linhai City (CN)

(72) Inventors: Huaqiang Shen, Linhai City (CN); Yilun Liu, Linhai City (CN)

(73) Assignee: Linhai Sunrise Leisure Products Co., Ltd., Linhai City (CN)

( * ) Notice: Subject to any disclaimer, the term of this patent is extended or adjusted under 35 U.S.C. 154(b) by 48 days.

(21) Appl. No.: 18/611,121

(22) Filed: Mar. 20, 2024

(65) Prior Publication Data

US 2024/0225262 A1 Jul. 11, 2024

(30) Foreign Application Priority Data

Feb. 28, 2024 (CN) ..... 202410221577.9

(51) Int. Cl.
*A47B 13/02* (2006.01)

(52) U.S. Cl.
CPC ..... *A47B 13/021* (2013.01)

(58) Field of Classification Search
CPC ..... A47B 13/021; A47B 2013/022; A47B 2200/0082; A47B 2200/08; A47B 91/024; E05C 19/14; F16B 12/48; F16B 12/52; Y10T 292/216
See application file for complete search history.

(56) References Cited

U.S. PATENT DOCUMENTS

| | | | | |
|---|---|---|---|---|
| 2,108,036 | A * | 2/1938 | Gowell | A47C 7/002 16/42 R |
| 5,686,700 | A * | 11/1997 | Carpinella | A47B 21/06 220/253 |
| D1,057,215 | S * | 1/2025 | Brunner | D25/133 |
| 2006/0071481 | A1* | 4/2006 | Anzai | E05C 19/14 292/256 |
| 2019/0159590 | A1* | 5/2019 | Lin | A47B 47/0075 |
| 2020/0128953 | A1 | 4/2020 | Goldhammer et al. | |
| 2022/0151374 | A1 | 5/2022 | DeVries et al. | |
| 2023/0136673 | A1 | 5/2023 | DeVries et al. | |

FOREIGN PATENT DOCUMENTS

| | | | | |
|---|---|---|---|---|
| DE | 202005009915 | U1 * | 10/2005 | F16B 9/02 |

* cited by examiner

*Primary Examiner* — Matthew W Ing

(57) ABSTRACT

The present invention discloses a portable table which comprises a table top, table legs and a locking mechanism; the table legs are respectively provided with a first seat body, the table top is provided with a second seat body, and the first seat body and the second seat body are connected by a connection mechanism; the connection mechanism comprises a snap-in groove and a snap-in block, the snap-in groove is arranged on the second seat body, and the snap-in block is arranged on the first seat body; and the first seat body is locked to the second seat body by the locking mechanism. The present invention can effectively prevent shaking between the table legs and the table top due to long-term use, and ensure stability of the connection between the table legs and the table top.

8 Claims, 9 Drawing Sheets

PORTABLE TABLE

TECHNICAL FIELD

The present invention pertains to the technical field of furniture, and particularly pertains to a portable table with table legs detachable from a table top.

BACKGROUND

In people's daily life, tables and chairs have become an indispensable part of people's lives. Today's tables are of a relatively bulky type, are relatively cumbersome to transport, and are inconvenient to carry when they are needed in outdoor activities. At present, there are some portable tables on the market, and the portable tables are mainly categories into three types. For the first type, the table furniture can be folded for stowage, which reduces footprint of the table by folding, but the folded table still has the disadvantages of large weight and complex structure; for the second type, table legs are folded and placed to a bottom of a table top for portable purpose; and for the third type, table legs are detachably connected to the table top, and the portable purpose is achieved by detaching the table legs from the table top, the bottom of the table top of such table are generally provided with mounting holes, one end of each of the table legs is directly inserted into the mounting hole, and the table legs may be directly removed from the mounting holes when the table needs to be transported or stowed. Although the table is very portable, there is a problem of unsecured assembly of the table legs, and the table legs become increasingly loose in the mounting holes due to repeated insertion and removal and bearing effect of the table top, rendering the table very unstable.

SUMMARY

It is the object of the present invention to design a portable table having excellent stability in order to solve the above technical disadvantages.

The portable table designed by the present invention comprises a table top, table legs and a locking mechanism; each of the table legs is provided with a first seat body at a root portion thereof, the table top is provided with second seat bodies at a bottom thereof, and the first seat body and the second seat body are connected in a fit manner by a connection mechanism; the connection mechanism comprises a snap-in groove and a snap-in block, the snap-in groove is arranged on the second seat body, and the snap-in block is correspondingly arranged on the first seat body, or the snap-in groove is arranged on the first seat body, and the snap-in block is correspondingly arranged on the second seat body; and the snap-in block is fitted into the snap-in groove, an inner wall of the snap-in groove and an outer wall of the snap-in block are arranged in a concave-convex fit, so that the snap-in block and the snap-in groove are connected in a fit manner, and the first seat body is locked to the second seat body by the locking mechanism.

The present invention has the following technical effects:

1. The table legs and the table top are respectively connected to the first seat bodies and the second seat bodies, opposite faces of the two seat bodies form a detachable connection by the connection mechanism, for example, the connection mechanism may be a dovetail groove guide rail structure, so that a sliding close fit is formed between the table legs and the table top, and the table legs may be directly detached from the table top; unlike insertion into mounting holes, the connection between the table legs and the table top according to the present invention is very stable, particularly with repeated changes in air temperature and humidity over time, such connection is very robust and stable. In addition, such connection does not require additional fasteners or adhesives for a fixed connection. It is therefore very environmentally friendly and cost effective, and very convenient to disassemble and assemble the table legs.

2. The locking mechanism is further arranged between the table legs and the table top, the locking mechanism mainly comprises a flipping portion, a first lock portion and a second lock portion, an elastic structure is provided between the second lock portion and the flipping portion to form an elastic connection, the elastic structure is mainly a spring structure, and the first lock portion is flipped forward and backward by the flipping portion to be locked to or unlocked from the second lock portion; when in a locked state, the spring structure tensions the second lock portion to stabilize locking of the two lock portions, thereby ensuring locking stability; and the elastic structure is arranged so that a deformation or relative small displacement between the table legs and the table top may be offset, so that the table legs do not shake relative to the table top, and the locking structure is simple in structure and easy to operate, so that parts and components will not fall off during locking, unlocking and loading, assembly and disassembly, which can avoid the problem of being unable to mount due to loss of parts and components.

Therefore, the present invention can effectively prevent shaking between the table legs and the table top due to long-term use, and ensure stability of the connection between the table legs and the table top.

Figure 1:
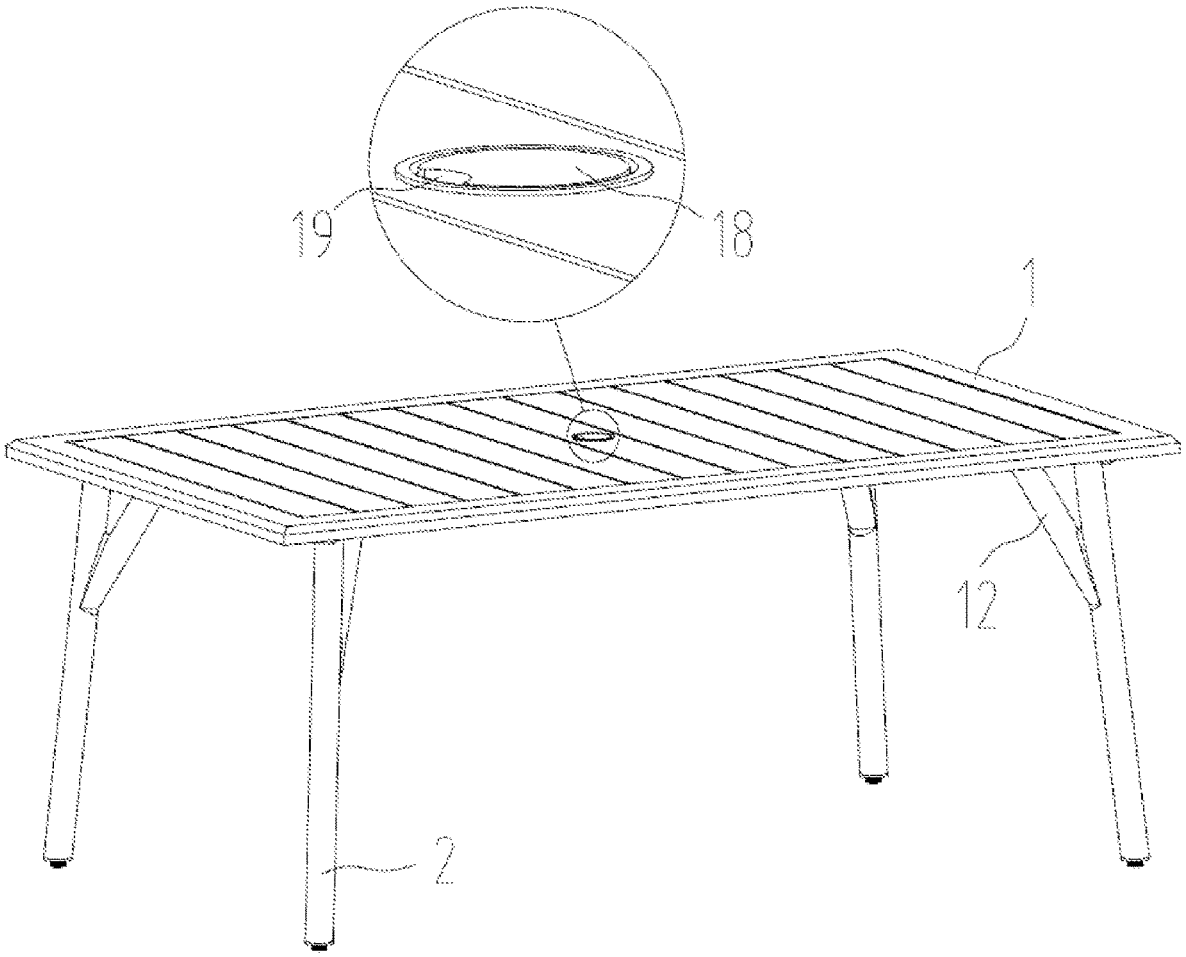
FIG. 1 is a front view of an overall structure.
Figure 2:
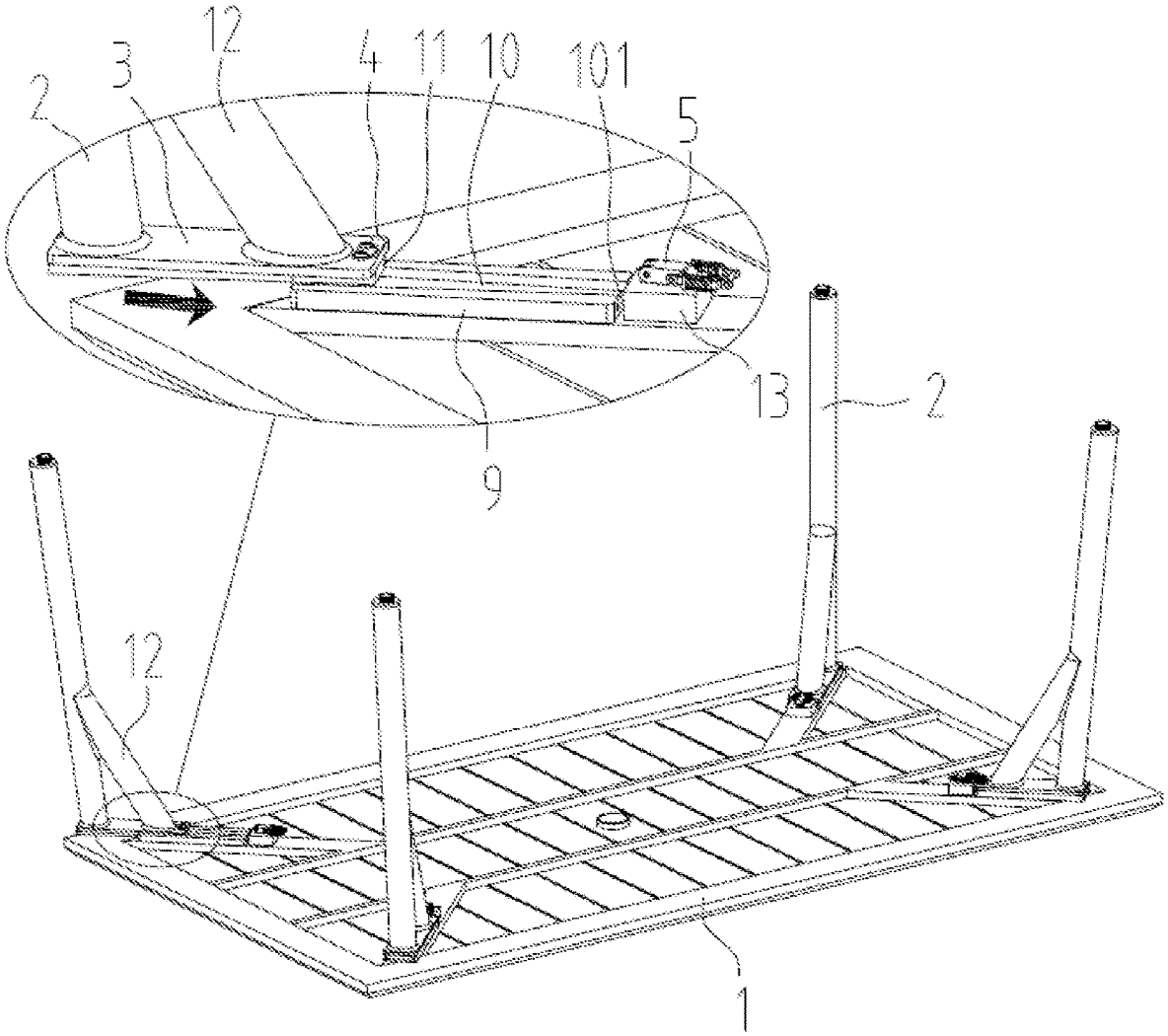
FIG. 2 is a rear view of an overall structure.
Figure 3:
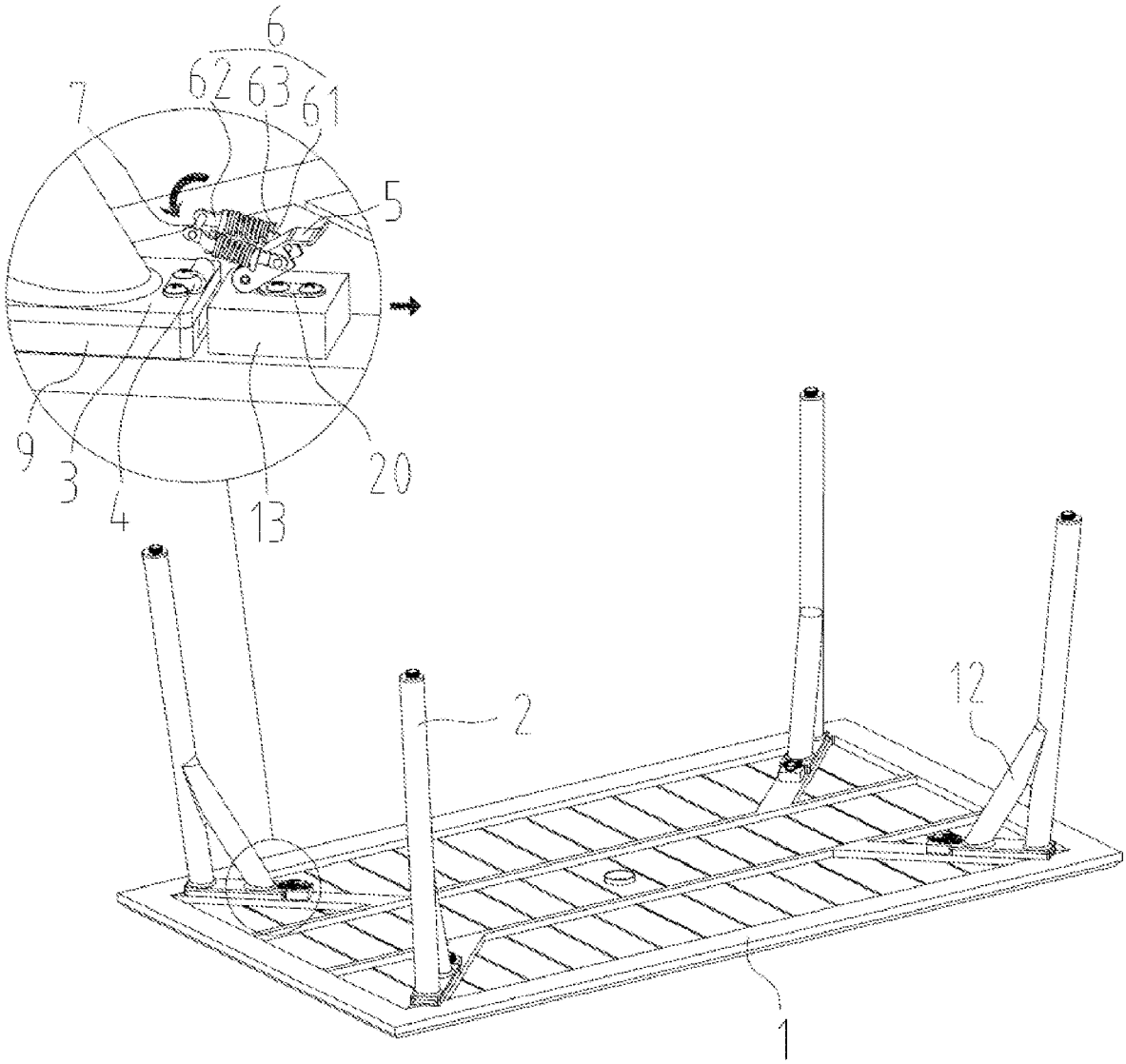
FIG. 3 is a view of a use state of a locking mechanism before locking.
Figure 4:
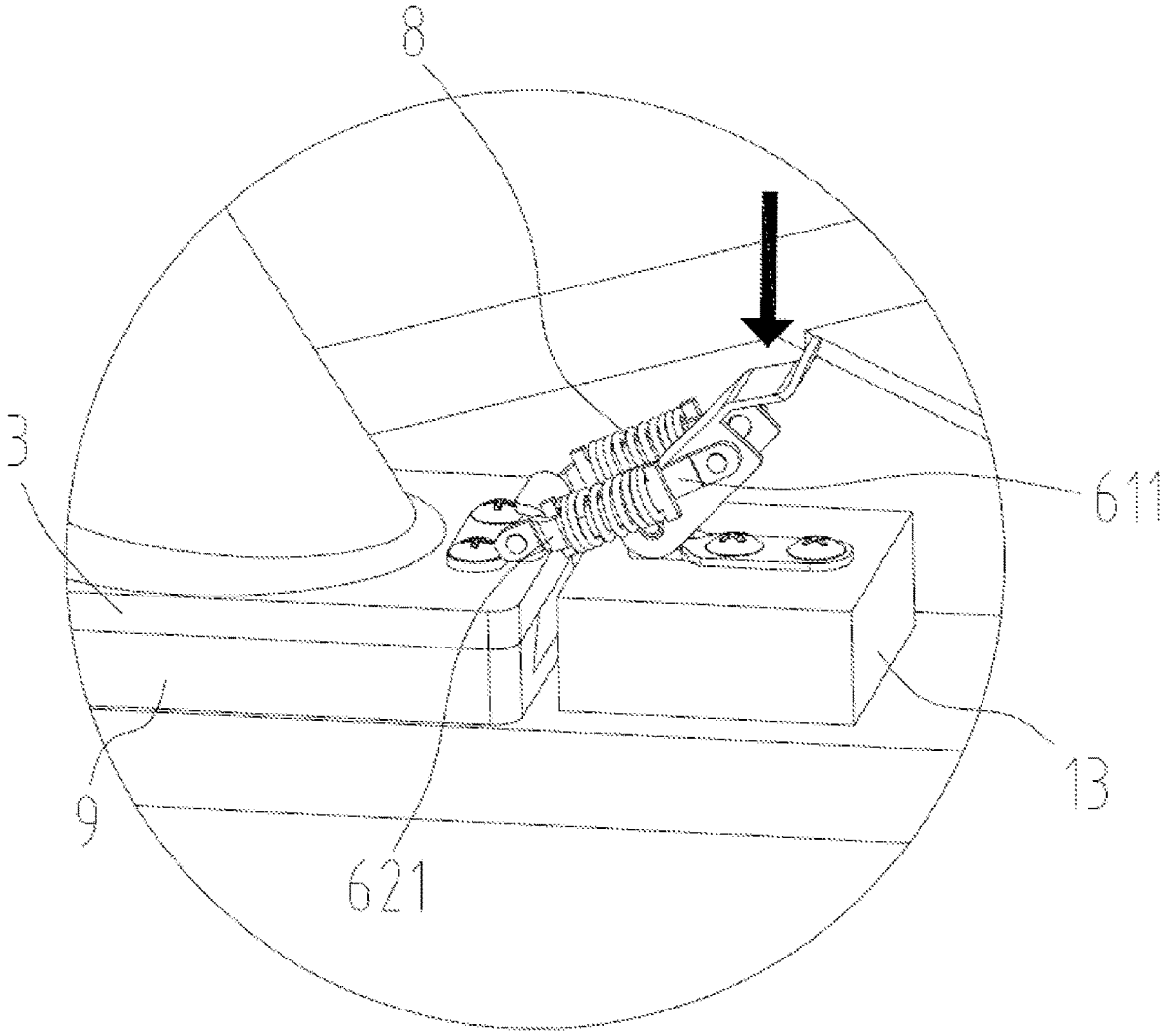
FIG. 4 is a view of a use state of a locking mechanism during locking.
Figure 5:
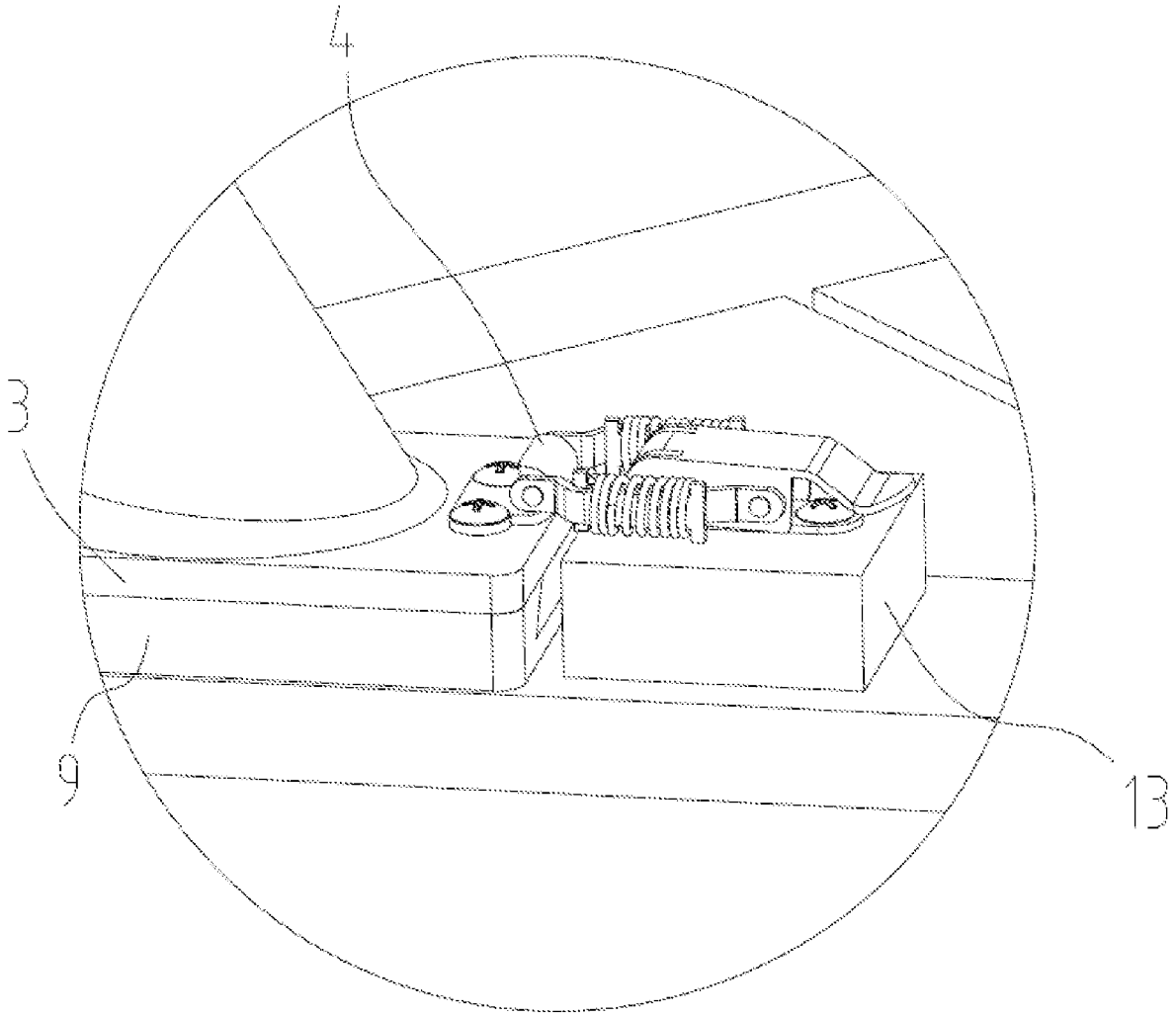
FIG. 5 is a view of a use state of a locking mechanism after locking.
Figure 6:
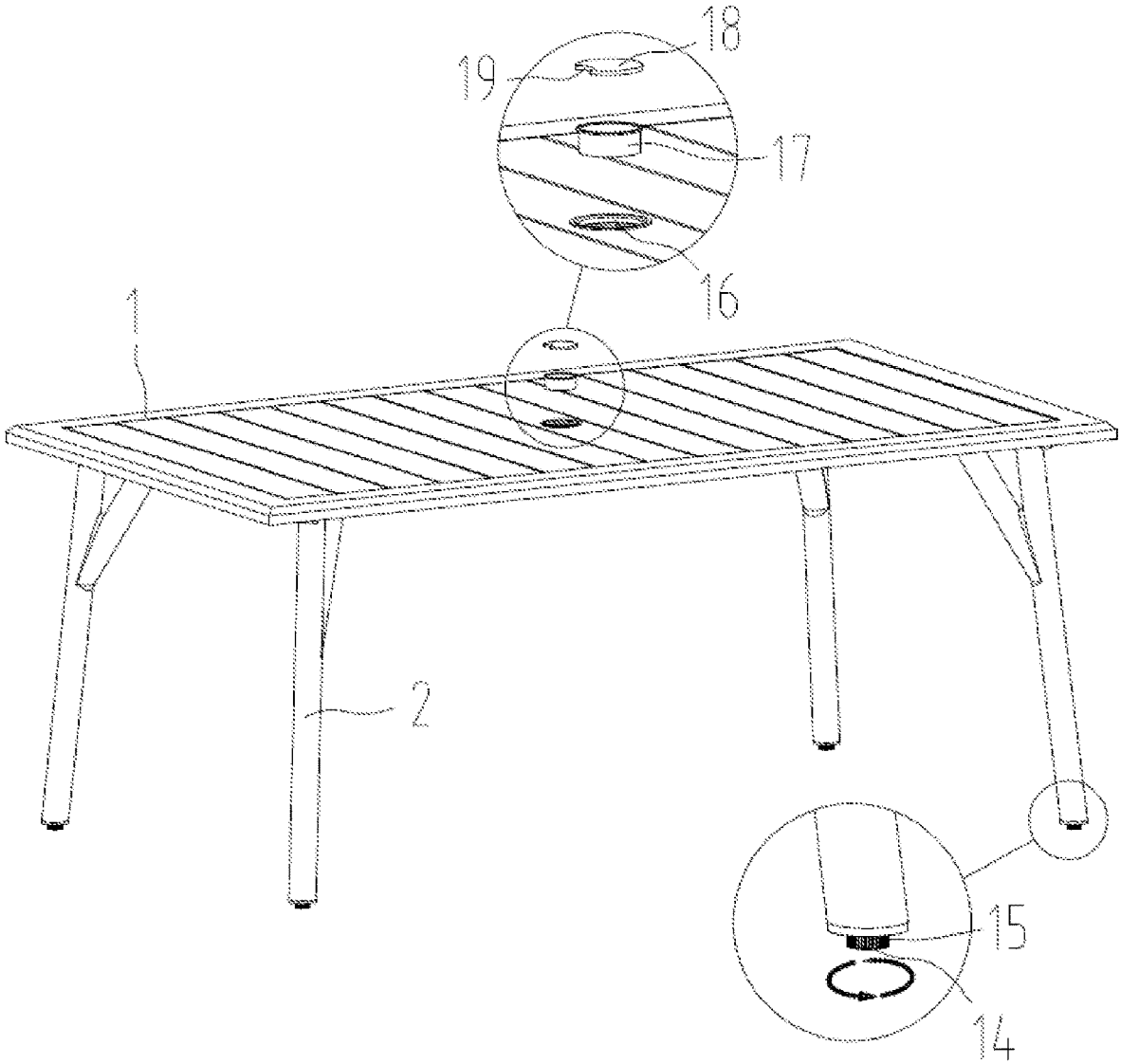
FIG. 6 is a structural diagram of a threading box and a foot pad.

In the drawings: 1. table top; 2. table leg; 3. first seat body; 4. first lock portion; 5. flipping portion; 6. connection portion; 61. first portion; 611. first rod body; 62. second part; 621. second rod body; 63. limiting portion; 7. second lock portion; 8. spring; 9. second seat body; 10. snap-in groove; 101. opening; 11. snap-in block; 12. reinforcing support portion; 13. third seat body; 14. foot pad; 15. anti-slip texture; 16. threading hole; 17. threading box; 18. cover plate; 19. slotted structure; 20. base; 21. convex portion; and 22. concave portion.

DESCRIPTION OF THE EMBODIMENTS

The technical solutions in the embodiments of the present invention will be clearly and completely described below in conjunction with the accompanying drawings in the embodiments of the present invention. Obviously, the embodiments described are only part but not all of the embodiments of the present invention. All other embodiments obtained by those of ordinary skill in the art based on the embodiments of the present invention fall within the scope of the present invention.

In the present embodiment, as shown in FIGS. 1-4, the portable table comprises a table top 1 and table legs 2, and there are generally four table legs 2 which are respectively located at four corners of a bottom of the table top 1; a first seat body 3 is provided at a root portion of each table leg 2; the first seat body 3 and the table legs 2 may be integrally formed by welding or connected by a fastener; after the first seat bodies 3 are fixed to the table legs 2, the table legs 2 are generally perpendicular to the first seat bodies 3 or the table legs 2 are inclined outwards at a certain angle; the first seat body 3 is detachably connected to the bottom of the table top 1, so that the table legs 2 are detachably connected to the bottom of the table top 1 by the first seat bodies 3; and a locking mechanism is provided between the first seat body 3 and the bottom of the table top 1 to lock the first seat body 3 to the table top 1 to prevent the table legs 2 from shaking or detaching from the table top 1 during use.

Figure 7:
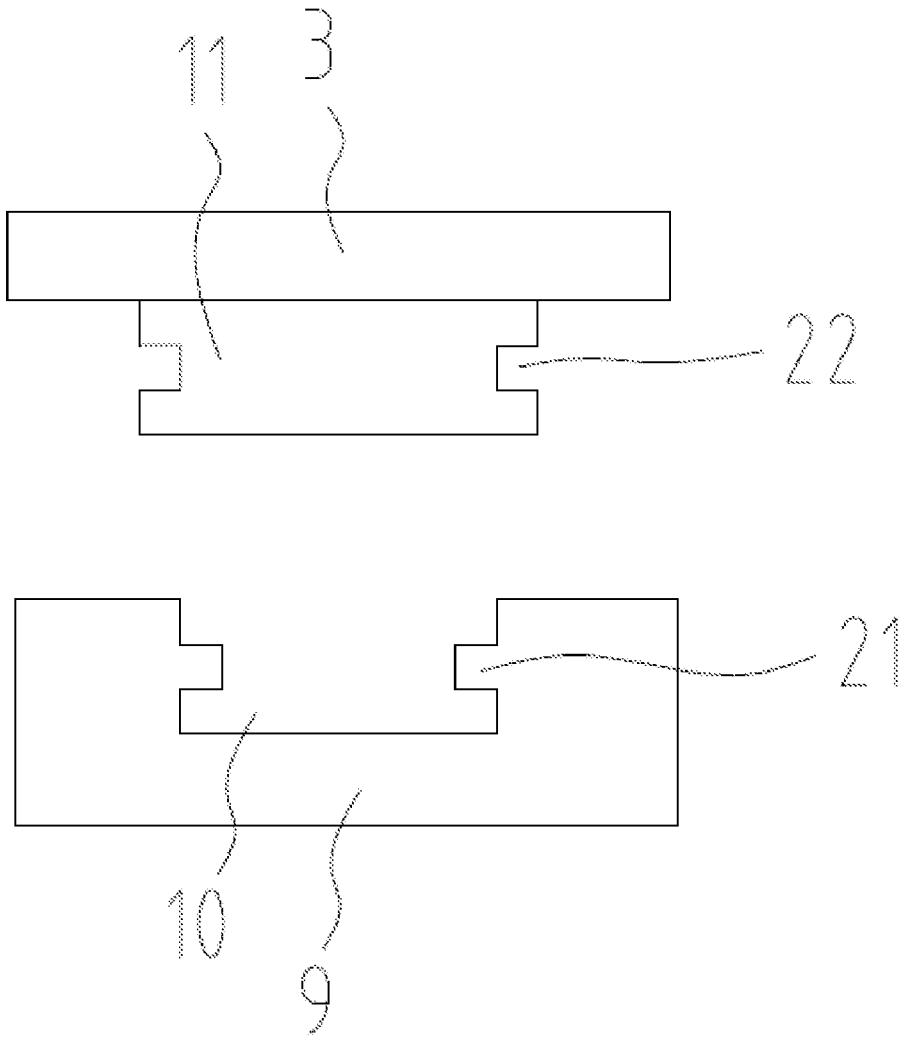
FIG. 7 is a cross-sectional view of a form of fit between a convex portion and a concave portion.
Figure 8:
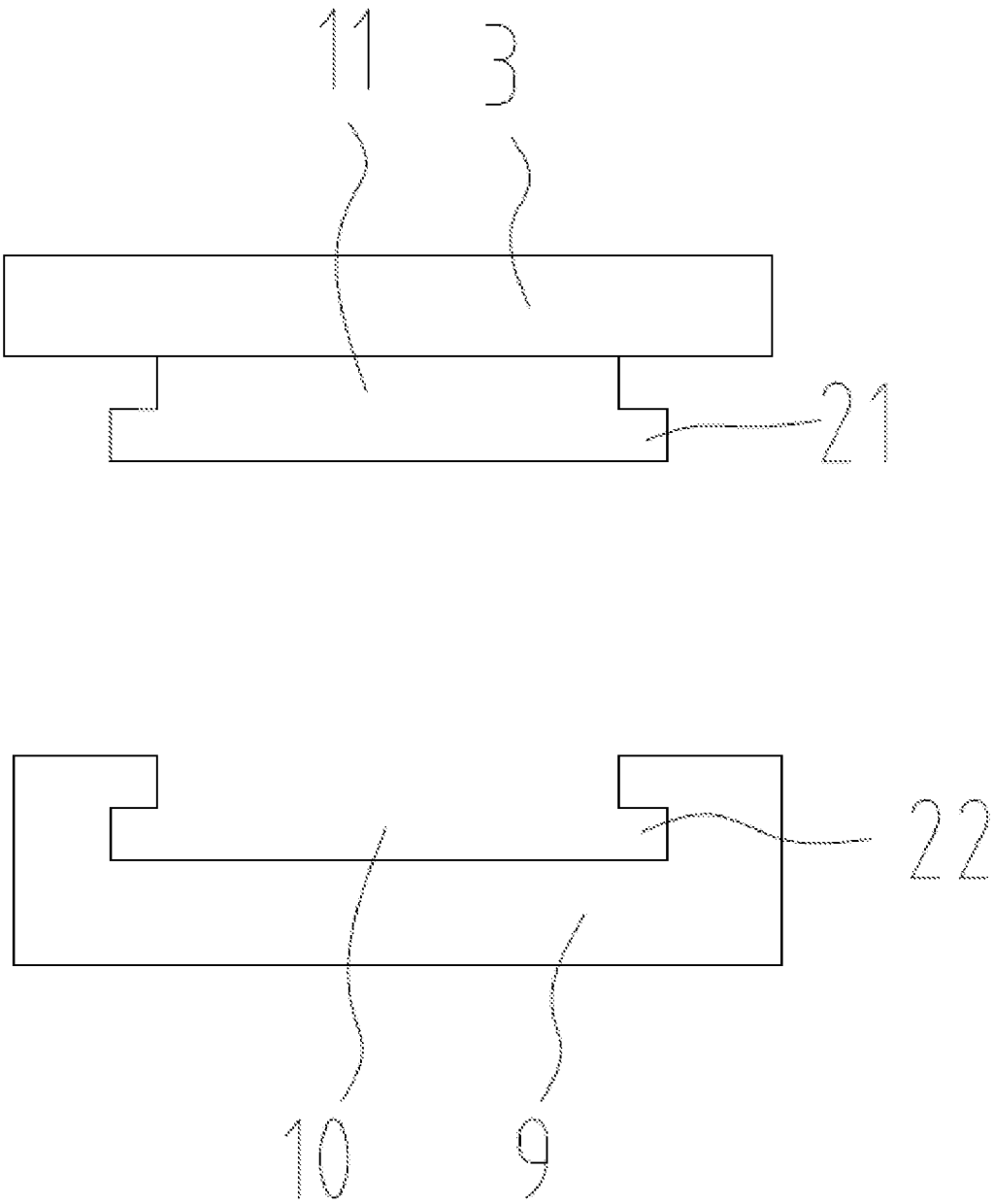
FIG. 8 is a cross-sectional view of another form of fit between a convex portion and a concave portion.

The bottom of the table top 1 is provided with second seat bodies 9, that is, the table legs 2 have the same number as the first seat bodies 3 and the second seat bodies 9, and they are arranged in one-to-one correspondence; the second seat bodies 9 may be fixed to the bottom of the table top 1 by fasteners, and may also be designed to be integral with the table top 1; and the first seat body 3 and the second seat body 9 are connected in a fit manner by a connection mechanism to achieve a detachable connection between the first seat body 3 and the second seat body 9, that is, achieving a detachable connection between the table leg 2 together with the first seat body 3 and the table top 1. Specifically, the connection mechanism comprises a snap-in groove 10 and a snap-in block 11; the snap-in groove 10 is arranged on the first seat body 3 or the second seat body 9, the snap-in block 11 is correspondingly arranged on the second seat body 9 or the first seat body 3, and an inner wall of the snap-in groove 10 and an outer wall of the snap-in block 11 are arranged in a concave-convex fit. That is, there are two fits, one is as shown in FIG. 7, the inner wall of the snap-in groove 10 is provided with an integral convex portion 21 arranged along a length direction thereof, the outer wall of the snap-in block 11 is provided with an integral concave portion 22 arranged along a length direction thereof, and the convex portion 21 is embedded in the concave portion 22; and the other is as shown in FIG. 8, the inner wall of the snap-in groove 10 is provided with an integral concave portion 22 arranged along the length direction thereof, the outer wall of the snap-in block 11 is provided with an integral convex portion 21 arranged along the length direction thereof, and the convex portion 21 is embedded in the concave portion 22.

In both cases, the snap-in block 11 and the snap-in groove 10 may be assembled with each other; and both ends of the snap-in groove 10 are respectively provided with an opening 101, so that the snap-in block 11 can be slidingly fitted from one end of the snap-in groove 10. It should be noted that the snap-in groove 10 and the snap-in block 11 have a certain length, so that the snap-in groove 10 and the snap-in block 11 are more stable after being assembled with each other. The locking mechanism is located at one end of the snap-in groove 10, and in the present embodiment, the locking mechanism is located at the end of the snap-in groove 10 facing a center of the table top 1, that is, the end of the snap-in groove 10 facing inwards, so that after the first seat body 3 and the second seat body 9 are assembled with each other by the connection mechanism, the locking mechanism can form locking between the first seat body 3 and the bottom of the table top 1 at one end of the connection mechanism.

Generally, the snap-in block 11 is located on the first seat body 3, and the snap-in groove 10 is located on the second seat body 9, so that when the table legs 2 are disassembled, the bottom of the table top 1 can form a flat surface, allowing the table top 1 to be placed separately.

Figure 9:
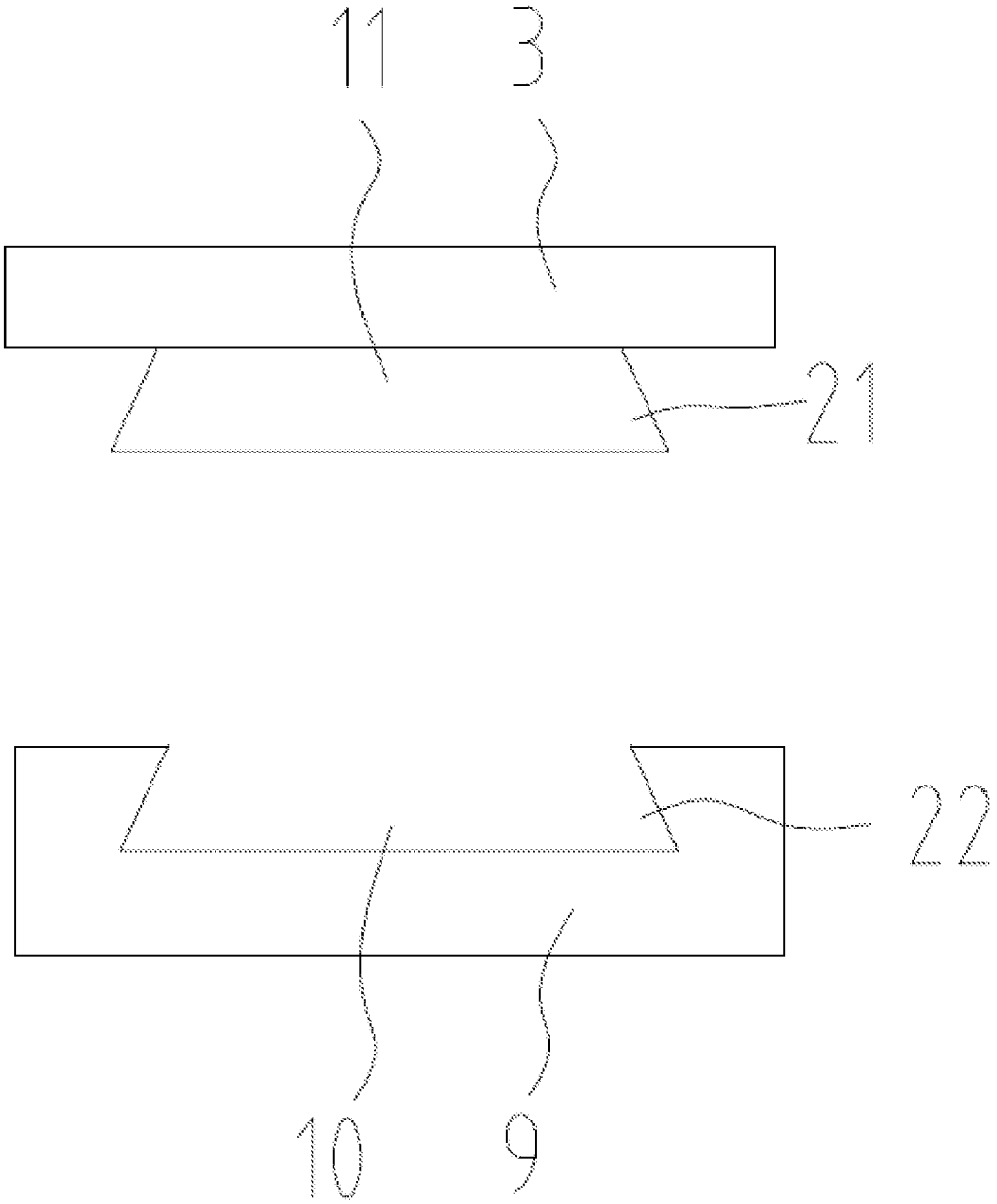
FIG. 9 is a cross-sectional view of a connection mechanism which is a dovetail groove rail structure.

In a preferred form of the present embodiment, the connection mechanism is a dovetail groove guide rail structure, the snap-in groove 10 is a dovetail groove, and the snap-in block 11 is a dovetail, and the two cooperate with each other to form a sliding and stable connection relationship. As shown in FIG. 9, the dovetail groove has the concave portion 22, and the dovetail has the convex portion 21.

In addition to the above-mentioned embodiment of the detachable connection between the table legs 2 and the table top 1, there may be a hooked connection between the table top 1 and the table legs 2, that is, a rotatable hooked connection is formed between one end of the first seat body 3 and the second seat body 9 or the bottom of the table top 1, and the other end of the first seat body 3 rotates to be fitted to and hooked or snapped with the second seat body 9. There may also be a rotatable connection between the table top 1 and the table legs 2, that is, one end of the first seat body 3 is rotatably connected to the second seat body 9 by a hinge or a hinge-like rotating structure, and the other end of the first seat body 3 is rotated to be attached to the second seat body 9 and fixedly connected to the second seat body by a fastener. Therefore, the first seat body 3 and the second seat body 9 are not limited to the above-mentioned detachable connection, and any detachable connection formed between the first seat body 3 and the second seat body 9 fall within the scope of the present invention.

The locking mechanism comprises a first lock portion 4, a flipping portion 5, a connection portion 6 and a second lock portion 7, the first lock portion 4 is connected to the first seat body 3, one end of the first lock portion 4 is fixedly connected to the first seat body 3 by a fastener, and the other end of the first lock portion 4 serves as a locking portion. In the present embodiment, the bottom of the table top 1 is provided with a third seat body 13 for mounting the flipping portion 5, so that the flipping portion 5 and the first lock portion 4 are at a same height and on a same straight line; and one end of the flipping portion 5 is rotatably connected to the third seat body 13, and the other end is provided with a connection portion 6. In the present embodiment, a base 20 is provided between the flipping portion 5 and the third seat body 13, the base 20 is fixedly connected to the third seat body 13 by a fastener, and one end of the base 20 is hinged with the flipping portion 5 by a shaft body, so that the flipping portion 5 can be flipped back and forth around the base 20. The connection portion 6 comprises a first portion 61 and a second portion 62; the first portion 61 comprises two first rod bodies 611 arranged along the length direction of the first seat body 3 or the second seat body 9, the two first rod bodies 611 are arranged opposite and spaced apart, and end portions of the two first rod bodies 611 are connected to the flipping portion 5; the second portion 62 comprises two second rod bodies 621 arranged along the length direction of the first seat body 3 or the second seat body 9, the two second rod bodies 621 are arranged opposite and spaced apart, and end portions of the first rod bodies 611 and the second rod bodies 621 are arranged parallel to each other and overlapped to form an overlapping portion; the overlapping portion is sheathed with a spring 8; opposite end portions of the first rod body 611 and the second rod body 621 are both formed with a limiting portion 63 limiting the spring 8, so that an elastic connection is formed between the first portion 61 and the second portion 62; and the second lock portion 7 is arranged between the two second rod bodies 621. In the present embodiment, the locking portion of the first lock portion 4 forms a hook-shaped end, and an abutting portion of the second lock portion 7 is a cross rod-shaped end, both ends of the cross rod-shaped structure are connected between the two second rod bodies 621, and the cross rod-shaped end and the hook-shaped end form a hooked connection to achieve locking.

When the flipping portion 5 is flipped towards the first seat body 3, the second portion 62 and the first portion 61 both are flipped with the flipping portion 5, in this case, the second lock portion 7 on the second portion 62 is flipped to the first lock portion 4, and in this case, the second lock portion 7 and the first lock portion 4 are on a same horizontal plane but have a certain distance. Then, the flipping portion 5 is flipped towards the third seat body 13, that is, the flipping portion is flipped towards an opposite direction of the first lock portion 4, the second portion 62 and the first portion 61 together are driven by the flipping portion 5 to move towards the third seat body 13, the second lock portion 7 also moves therewith, and the second lock portion 7 moves to form a hooked connection with the first lock portion 4. In this case, the flipping portion 5 continues to be flipped towards the third seat body 13. Due to the elastic connection between the second portion 62 and the first portion 61, the second portion 62 and the first portion 61 are elastically extended, and the second lock portion 7 is tensioned under an elastic action, so that a stable locking is formed between the second lock portion 7 and the first lock portion 4 under an elastic acting force. When unlocking is required, the flipping portion 5 only needs to be flipped towards a direction of the first seat body 3, and the flipping portion 5 drives the second portion 62 and the first portion 61 to move towards the first seat body 3 until the second portion 62 moves until the second lock portion 7 loses the elastic acting force. In this case, the second lock portion 7 may be easily detached from the first lock portion 4 to complete the unlocking. The elastic connection has the advantages of enabling the first lock portion 4 and the second lock portion 7 to be in a stable locking connection under the action of an elastic tensioning force, and enabling the first seat body 3 and the third seat body 13 or the bottom of the table top 1 to form an elastic connection, so that when the table legs 2 move together with the first seat bodies 3 relative to the second seat bodies 9, the elastic tensioning force always pulls the first seat body 3 and the third seat body 13 between each other. That is, when the table legs 2 move or dislocate relative to the table top 1 during long-term use, the elastic connection enables the table legs 2 to still maintain a stable fixation relationship with the table top 1, and the table legs 2 are always elastically tensioned, so that the table legs 2 do not move all the way to detachable from the table top 1.

It should be noted that when the flipping portion 5 is flipped to be in a locked state, a hinged point of the first portion 61 and the flipping portion 5 and a locking point of the two lock portions are on a same horizontal straight line, or the hinged point is in a lower position relative to the locking point, and a certain snap-fit structure is formed between the flipping portion 5 and the base 20, so that when in the locked state, the flipping portion 5 will not be accidentally flipped by being pulled by the elastic tensioning force in a reverse direction which loosens the locking between the second lock portion 7 and the first lock portion 4, and such accident can be avoided as long as the flipping portion 5 can be stably flipped into a snap fit with the base 20. When the unlocking is required, the flipping portion 5 can be easily flipped by manually applying a slight force to the flipping portion 5 to release snap fit between the flipping portion 5 and the base 20. The snap-fit structure may be, for example, obtained by providing a cross rod on an inner wall of the flipping portion 5, providing a recessed area at a middle position of the cross rod, and providing a protrusion at a corresponding position on the base 20, and rotating the flipping portion 5 to snap the protrusion into the recessed area to form the snap fit between the flipping portion 5 and the base 20. This is of course only one of snap-fit structure designs, and the present invention is not limited to the above-mentioned snap-fit structure. Any snap-fit structure which enables the flipping portion 5 to be released from the base 20 only by an external force is within the scope of the present invention.

A reinforcing support portion 12 is provided between the table leg 2 and the first seat body 3. In the present embodiment, the reinforcing support portion 12 is of a strip-shaped or tubular structure, and one end of the reinforcing support portion 12 is connected to the table leg 2 or is integrated with the table leg 2, a connection point between the table leg 2 and the reinforcing support portion 12 is at a certain distance from a connection point between the table leg 2 and the first seat body 3, and the other end is connected to the first seat body 3 away from the root portion of the table leg 2, so that a triangular structure is formed among the reinforcing support portion 12, the first seat body 3 and the table leg 2; and the third seat body 13 is arranged close to the reinforcing support portion 12, so that the locking mechanism is arranged close to the reinforcing support portion 12, and finally so that a fixing point of the locking mechanism, the reinforcing support portion 12 and the first seat body 3 is on a same horizontal straight line as a fixing point of the root portion of the table leg 2 and the first seat body 3, so that the table leg 2 together with the first seat 3 can be more stably connected to the bottom of the table top 1.

In the present embodiment, since a top end of the table leg 2 is inclined outwards and the reinforcing support portion 12 is also inclined, the locking mechanism is very close to a connection point between and the reinforcing support portion 12 and the first seat body 3; therefore, during use of the table top 1, a locking force of the locking mechanism is balanced with an outward acting force of the table leg 2, that is, the locking mechanism can be elastically tensioned to act on the table leg 2 at all times to prevent the table leg 2 from detaching from the bottom of the table top 1. It should be noted that due to the spring 8 of the locking mechanism, it does not matter even if there is a small relative displacement between the first seat body 3 and the second seat body 9. The elastic connection always forms the tensioning force to pull the first seat body 3, resulting in good stability between the table top 1 and the table legs 2 without shaking between the table top 1 and the table legs 2 in this case. In addition, a spring 8 with a larger elastic coefficient may be used, resulting in a greater elastic tensioning force, and better stability between the table legs 2 and the table top 1.

In the present embodiment, both the first seat body 3 and the second seat body 9 are an elongated plate-like structure, the dovetail groove 10 and the guide rail 11 are also relatively arranged along a length direction of the elongated plate-like structure, and an outer diameter of end portions of the table leg 2 and the reinforcing support portion 12 is equal to or smaller than a width of the first seat body 3, so that the first seat body 3 can still form a stable connection with the second seat body 9 under the action of the table leg 2.

Preferably, a lower end of the table leg 2 is provided with a foot pad 14, a center of a surface of the lower end of the table leg 2 is provided with a screw hole, a stud at one end of the foot pad 14 is screwed into the screw hole, and the other end is in contact with the ground as a support end. A distance between the support end and a top of the table leg 2 is adjusted by rotating the foot pad 14, so that a height of the table top 1 is adjustable; and the support end is provided with an anti-slip texture 15 on a periphery thereof to facilitate rotation.

Preferably, a threading hole 16 is provided on the table top 1, a threading box 17 is provided in the threading hole 16, a cover plate 18 is rotatably connected to an opening of the threading box 17, and a slotted structure 19 is provided on the cover plate 18 for a connecting line of an electronic product to pass through.

In the present embodiment, there are four table legs 2 which are respectively located at four corners of the table top 1. However, there may be three table legs 2 which are respectively located in three directions of the table top 1 in a triangular structure. In addition, there may be more than four table legs 2, in this case, the table legs 2 are evenly distributed along the center of the table top 1 in a circumferential array.

The present invention is not limited to the above-mentioned preferred embodiments, and any other products in various forms can be obtained by anyone in the light of the present invention, but any changes in the shape or structure thereof, which have the same or similar technical solutions as those of the present application, fall within the scope of the present invention.

What is claimed is:

1. A portable table, comprising a table top, table legs and a locking mechanism, wherein each of the table legs is provided with a first seat body at a root portion thereof, the table top is provided with second seat bodies at a bottom thereof, and the first seat body and the second seat body are connected by a connection mechanism; the connection mechanism comprises a snap-in groove and a snap-in block, the snap-in groove is arranged on the second seat body, and the snap-in block is correspondingly arranged on the first seat body, or the snap-in groove is arranged on the first seat body, and the snap-in block is correspondingly arranged on the second seat body; and the snap-in block is engaged into the snap-in groove, an inner wall of the snap-in groove and an outer wall of the snap-in block are arranged in a concave-convex engagement, so that the snap-in block and the snap-in groove are connected, and the first seat body is locked to the second seat body by the locking mechanism;

both ends of the snap-in groove are formed with an opening communicating with the snap-in groove, the bottom of the table top is provided with a third seat body for rotatably mounting the flipping portion, the third seat body is adjacent to an end portion of the second seat body, and the third seat body shields the opening at the end portion to limit an end portion of the first seat body having the first lock portion;

four second seat bodies are arranged and are respectively located at four corners of the bottom of the table top, each of the second seat bodies is inclined relative to an edge of the table top, the first seat body is respectively arranged beside each of the second seat bodies, and the third seat body is respectively arranged at an inward end portion of each of the second seat bodies, so that the snap-in block slides into the snap-in groove through the opening at an outward end portion of the second seat body, and each of the third seat bodies is provided with the locking mechanism; and the table legs are inclined outward.

2. The portable table according to claim 1, wherein the locking mechanism comprises a first lock portion connected to the first seat body, a flipping portion rotatably connected to the table top, a connection portion rotatably connected to the flipping portion, and a second lock portion provided at the connection portion and locked with or unlocked from the first lock portion, the connection portion comprises a first portion and a second portion, one end of the first portion is rotatably connected to the flipping portion, one end of the second portion is provided with the second lock portion, and opposite end portions of the first portion and the second portion are elastically connected.

3. The portable table according to claim 2, wherein a hook-shaped end is formed on the first lock portion; and an end portion of the connection portion forms an abutting end hooked with the hook-shaped end as the second lock portion.

4. The portable table according to claim 2, wherein the first portion comprises two first rod bodies provided along a length direction of the first seat body or the second seat body, the two first rod bodies are arranged opposite and spaced apart, and end portions of the two first rod bodies are rotatably connected to the flipping portion; the second portion comprises two second rod bodies provided along the length direction of the first seat body or the second seat body, and the two second rod bodies are arranged opposite and spaced apart; and end portions of the first rod body and the second rod body are arranged parallel to each other and overlapped to form an overlapping portion, the overlapping portion is sheathed with a spring, opposite end portions of the first rod body and the second rod body are both formed with a limiting portion limiting the spring, so that an elastic connection is formed between the first portion and the second portion, and the second lock portion is arranged between the two second rod bodies.

5. The portable table according to claim 1, wherein the snap-in groove is arranged along the length direction of the first seat body, and the snap-in block is arranged along the length direction of the second seat body;

the inner wall of the snap-in groove is provided with a convex portion arranged along a length direction thereof, the outer wall of the snap-in block is provided with a concave portion arranged along a length direction thereof, and the convex portion is embedded in the concave portion, or the inner wall of the snap-in groove is provided with a concave portion arranged along a length direction thereof, the outer wall of the snap-in block is provided with a convex portion arranged along a length direction thereof, and the convex portion is embedded in the concave portion.

6. The portable table according to claim 1, wherein a reinforcing support portion is provided between the table leg and the first seat body, both ends of the reinforcing support portion are respectively connected to the table leg and the first seat body, an end portion of the reinforcing support portion connected to the first seat body is away from the root portion of the table leg, and the third seat body is arranged adjacent to the reinforcing support portion, so that the locking mechanism is arranged adjacent to the reinforcing support portion, so that a fixing point of the locking mechanism, the reinforcing support portion and the first seat body is on a same horizontal straight line as a fixing point of the root portion of the table leg and the first seat body.

7. The portable table according to claim 6, wherein a foot pad is threadedly connected to a lower end of the table leg, a lower end of the foot pad is in contact with the ground as a support end, a distance between the support end and the lower end of the table leg is adjustable by rotating the foot pad, and the support end is provided with an anti-slip texture on a periphery thereof to facilitate rotation.

8. The portable table according to claim 1, wherein a threading hole is provided on the table top, a threading box is provided in the threading hole, a cover plate is rotatably connected to an opening of the threading box, and a slotted structure is provided on the cover plate for a connecting line of an electronic product to pass through.

* * * * *